United States Patent [19]

Schwartz

[11] 4,091,368

[45] May 23, 1978

[54] METHOD AND APPARATUS TO OBTAIN AN ELECTRICAL SIGNAL REPRESENTATIVE OF THICKNESS OF A TRAVELING FILAMENT

[75] Inventor: Hermann Schwartz, Pfaffikon, Switzerland

[73] Assignee: Siegfried Peyer, Bach, Switzerland

[21] Appl. No.: 746,520

[22] Filed: Dec. 1, 1976

[30] Foreign Application Priority Data

Dec. 4, 1975 Switzerland ..... 15813/75

[51] Int. Cl.[2] ..... G01N 21/48

[52] U.S. Cl. ..... 340/259; 139/273 A; 250/571; 356/159

[58] Field of Search ..... 340/258 D, 259; 250/559, 571; 356/51, 199, 200, 238, 159, 160; 139/273 A

[56] References Cited

U.S. PATENT DOCUMENTS

| | | | |
|---|---|---|---|
| 3,001,438 | 9/1961 | Warthen | 356/159 |
| 3,053,986 | 9/1962 | Loepfe et al. | 356/159 |
| 3,099,829 | 7/1963 | Namenyi-Katz | 340/259 |
| 3,139,911 | 7/1964 | Breitmeier | 340/259 |
| 3,892,492 | 7/1975 | Eichenberger | 356/199 |
| 3,941,485 | 3/1976 | Madden | 356/159 |

*Primary Examiner*—John W. Caldwell, Sr.
*Assistant Examiner*—Joseph E. Nowicki
*Attorney, Agent, or Firm*—Flynn & Frishauf

[57] ABSTRACT

To provide a more representative output signal on electro-optical transducers scanning a traveling filament, such as a textile thread than heretofore possible, a beam of light is passed to the filament and the light reflected therefrom is analyzed and transduced into an electrical signal, so that light passing laterally of the filament is eliminated from the pick-up to provide an output signal in the pick-up representative only of the portion of the thread which is actually illuminated.

11 Claims, 3 Drawing Figures

Figure 1:
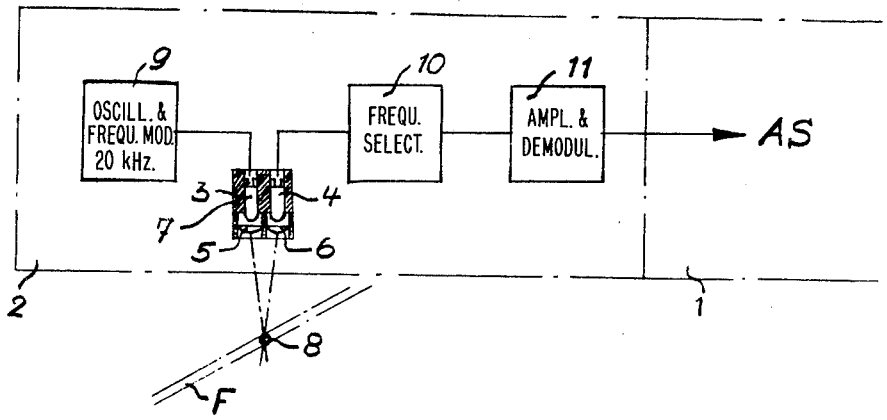

METHOD AND APPARATUS TO OBTAIN AN ELECTRICAL SIGNAL REPRESENTATIVE OF THICKNESS OF A TRAVELING FILAMENT

The present invention relates to a method and apparatus to obtain an electrical output signal respresentative of a traveling filament, typically a textile thread or yarn, and more particularly to such a system in which the filament is illuminated and an optical-electrical transducer transduces a resulting light output signal to electrical signals which are then evaluated.

The system and method of the present invention are particularly suitable for combination with thread or yarn cleaning apparatus through which a textile filament passes. It has previously been proposed to use photo-electric transducers, typically photo-electric measuring cells, to obtain an electrical signal representative of a light signal derived from the illuminated yarn. The electrical signal, representative of the yarn, is then used to control functions or operations of textile machinery, for example to cut out portions of thread of excess thickness, slubs, knots, and the like.

Structures of this type have used two elements located closely spaced from each other. One of the elements was a light source shining light on the thread, and the other a light receiver and electrical transducer. A measuring area was defined by the beam of light impinging on the light receiver, and the thread or filament was passed through the measuring area.

The measuring area had to be of such a size that it could accept threads or filaments of various thickness. Thickened portions of the respective filaments may well have a multiple of the normal or standard thread thickness. It is practically impossible to prevent certain vibrations of the thread transversely to its running direction, so that the measuring field must be of sufficient width to accommodate lateral excursions thereof. The measuring area of the measuring field thus had to be a multiple of the maximum filament diameter for which the apparatus was designed.

Increasing the size of the measuring field or, for all practical purposes, the width of the measuring field transverse to the running direction of the thread, results in a received light signal by the pick-up signal which forms a base or d-c component of a substantial level, and usually a substantial multiple of the actual output signal derived from thickness variations of the thread itself.

The basic signal is derived from the light transmitted by the light source. If no thread is in the measuring field, a 100% signal will be received by the receiver. Upon introduction of a thread into the field, there will be a reduction in the base signal; this reduction will be small, corresponding to the absolute diameter of the thread or filament. This diameter signal is the basis for the further operation of the transducer, and hence of the yarn cleaning or other textile apparatus. It is the signal which has to be evaluated. Since the thread diameter signal may be only a few percent of the base signal, however, extreme accuracy is required in order to obtain a stable and precisely representative output signal which is suitable to reflect, electrically, the diameter of the thread in the measuring field. Obtaining such signals is expensive and requires much apparatus, particularly when the signals are to be derived from thin threads or yarns passing through the measuring field. Some filaments may attenuate the base output signal by only 1%, so that variations from this 1% attenuation can be detected only with great difficulty.

To reduce the size of the measuring field, it has been proposed to form them by projecting a narrow beam, defined by a slit. Slits tend to become dirty, accept deposits of fluff and lint, and such deposits which attenuate light from the light transmitter to receiver cause erroneous signals. They may also overall decrease the base signal. Uniform dirt, lint or fluff deposits can be compensated electrically. This assumes, however, that the extent of contamination or attenuation by dirt and the like is homogeneous over the entire measuring field, typically the width of the slit. This is not usually the case, however, and only certain localized areas within the measuring field tend to accumulate dirt or contamination; these areas are not necessarily in the immediate vicinity of the passage of the thread therethrough. If, in such a case, the base signal is adjusted electrically to meet its standardized design value, then the measured value for instantaneous thread positions passing through the measuring field may no longer be accurate. The ratio of thread diameter signal to the base signal has been changed in the direction of a simulated thicker thread, causing improper operation of the entire sensing apparatus. Control of the base signal to adjust it to a precise, desired value thus does not provide assurance that the derived thread diameter signal will be representative of the actual thread diameter.

The base signal can be eliminated electronically in the further evaluation of the derived output signal. The thread diameter signal must be amplified and then evaluated. The base signal can be eliminated by a comparator, difference circuit, or the like. The requirements placed on the circuit and network elements with respect to stability and accuracy are high, resulting in expensive and sensitive apparatus, subject to drift or malfunction.

It is an object of the present invention to provide a method and apparatus to obtain an electrical signal truly representative of a filament, typically a textile thread or yarn which is representative only of the filament and does not have the problems which arose in prior art systems and apparatus.

SUBJECT MATTER OF THE PRESENT INVENTION

Briefly, light is projected towards the thread and then an electrical signal is derived representative of the light which is reflected from the surface of the thread. Thus, a diffuse surface reflection image of the thread is obtained, which then serves to provide an electrical signal representative of the thread diameter. The apparatus is so constructed that, preferably, the light transmitter and the light receiver, typically a semiconductor photoresponsive element, are located adjacent each other, at the same side of the thread, so that light reflected from the surface of thread only is received by the photoelectric transducer.

The signal derived from the transducer will be only that one which is diffusely reflected from the surface of the filament if a filament is located within the measuring region or measuring zone, and immediately adjacent the opticalelectrical transducer. If there is no filament, no light will be reflected to the transducer, and the light from the source will be beamed without interruption and without reflection into space. Thus, the only signal which can be picked up by the transducer is the reflected signal from the filament, and thus the signal will be a true representation of the filament itself. Special arrangements to keep a measuring slit clean need not be employed since all elements of the measuring cell, that is, the source as well as the transducer are on the same side of the thread.

Preferably, an optical system is used in combination with the light source as well as with the optical-electronic transducer which is so arranged that the optical axes of the systems cross in the region of the filament. The light transducer, in accordance with a preferred embodiment, is a light-emitting diode, such as GaAs-LED, which provides infrared radiation. This type of radiation provides for outputs which are essentially independent of visible colors of the filament, so that the influence of the color of the filament itself on the measuring sensitivity is substantially eliminated.

The influence of stray light on the light receiver can be effectively eliminated by modulating the light transmitter with a relatively high frequency, for example in the order of about 20 kHz, to obtain unambiguous separation of the reflected signals and ambient signals in the receiver and in any amplification circuitry connected thereto.

Figure 2A:
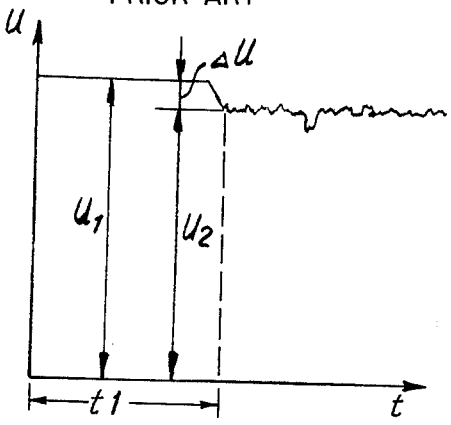
Fig. 2a PRIOR ART
Figure 2B:
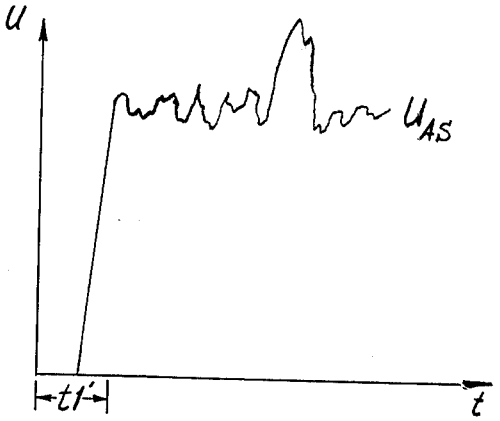

The invention will be described by way of example with reference to the accompanying drawings, wherein:

FIG. 1 is a schematic diagram of an electronic yarn cleaning system in accordance with the present invention;

FIG. 2*a* is a voltage-time diagram of voltages derived from measuring systems of the prior art; and FIG. 2*b* is a diagram similar to FIG. 2*a*, but showing the output derived by the system in accordance with the present invention, and operating in accordance with the method of the present invention.

Basically, the system is used with an electronic yarn cleaning apparatus 1 which has a measuring cell element 2 and additional evaluation circuitry for the output signal AS derived from the measuring cell. The evaluation circuitry itself may be any one of known circuits including, for example, a threshold switch, comparators, limit sensing circuits, and the like.

The measuring cell 2 has a photo-electric transducer assembly which includes a light source 3 and a reflected light optical-electrical transducer 4. The light source preferably is an infrared light source, for example a GaAs-LED; the transducer element 4 preferably is a silicon semiconductor optical element, for example a silicon optical diode or transistor.

Both the light source 3 as well as the optical-electrical transducer or receiver 4 are provided with optical system 5, 6 located in the optical paths thereof. A housing 7 holds the source 3, transducer 4 and the optical components of the optical systems 5, 6. The optical axes of the systems are so arranged that they intersect at the intersecting point 8. Filament F is guided to pass through the intersecting point 8 by suitable guide rollers or the like (not shown). The elements 3, 4 are located immediately adjacent each other in the socket 7.

Response to stray extraneous light can be suppressed by powering the light source 3 from an oscillator and frequency modulator 9, which provides, for example, oscillations at a frequency of 20 kHz, or pulses of a similar frequency. Thus, unit 9 may be a pulse generator with a suitable frequency modulation stage as well. The source 3 thus will emit modulated light.

Receiver 4 is tuned to selectively respond to light modulated by the frequency derived from the oscillator or pulse generator 9. A frequency selective stage 10 including, for example, a filter or a circuit functioning as a filter and selective with respect to the frequency of oscillator 9, is connected to the output of transducer element 4; the output of the frequency selection stage 10 is applied to an amplifier, which may further include a demodulator, from which the output signal AS is then derived. The frequency selection stage 10 and the amplifier 10 can be combined in a single unit, for example by using a frequency-selective amplifier.

When using a system in accordance with the prior art in which the transducing unit provides electrical signals representative of transmitted light, signals as shown in FIG. 2*a* will be derived. A base signal $U_1$ will be obtained from the transducer when no filament F is present. Upon introduction of the filament into the measuring zone, the base signal $U_1$ will be reduced to the value $U_2$; the change $\Delta U$ corresponds to the absolute diameter of the filament F. The electrical representation of that absolute filamentary diameter is, however, only a few percent of the base signal $U_1$; the stability thereof depends on the stability of the base signal $U_1$. In order to obtain an output signal of substantial accuracy, however, corresponding closely to the thread diameter, the base signal $U_1$ must be more accurate than the difference signal $\Delta U$ by several orders of magnitude. If the filament F is very thin, so that the difference signal $\Delta U$ is only about 1% of $U_1$, this means that the accuracy of $U_1$ must be one hundred times that of the value $\Delta U$, required to obtain an output signal reliably representative of the filament F itself.

The system in accordance with the invention operates differently, and as shown in FIG. 2*b*. If no filament F is present, the base signal will be zero. The absence of filament is indicated in FIG. 2*a* by the time *t*1. A comparable time *t*1′ is shown in FIG. 2*b*. As the filament F is introduced into the measuring zone, the surface thereof will provide a diffuse reflection signal which is received by the receiving transducer element 4 and will precisely correspond to the thickness of the filament at position 8. Thus, the output signal $U_{AS}$ will be an accurate electrical representation of the thickness of the filament, as seen in FIG. 2*b*.

Various changes and modifications may be made; for example, the optical systems can be so arranged that the axes thereof are parallel, or essentially parallel, so that the position of the filament F need not be accurately maintained, and the filament F can be placed at positions with respect to the transducer assembly within an extensive range.

I claim:

1. Method to obtain an electrical signal representative of the diameter of a traveling filament (F) including the steps of generating a beam of radiation; passing the filament continuously in a path exposed to the beam; transducing the beam into an electrical signal; and evaluating the transduced signal wherein the step of passing the filament in the beam of radiation comprises directing the beam of radiation to the surface of the filament to irradiate the filament continuously passing in the path of the beam to obtain a diffuse reflection from the surface of the filament;

the transducing step comprises continuously sensing the reflection from the surface of the filament and deriving a transduced signal continuously representative of the irradiated, and hence reflecting surface of the filament;

and the evaluation step comprises continuously evaluating the instantaneous characteristics of the transduced signal to obtain a continuous signal instantaneously representative of the diameter of the filament (F).

2. Method according to claim 1, wherein the radiation beam generating step comprises generating a beam of light in the infrared range.

3. Method according to claim 1, wherein the radiation beam generating step comprises generating a beam of modulated light, and the transducing step comprises filtering the signal with respect to the modulation frequency of the generating beam.

4. Method according to claim 1, wherein the radiation beam generating step comprises generating a beam of light in the infrared range modulated with a modulation frequency of about 20 kHz;

and the transducing step comprises filtering the signal with respect to the modulation frequency of the generated beam.

5. Apparatus to continuously monitor the thickness of a filament traveling in a predetermined path comprising means (3) generating a beam of radiation and directing said beam unto the filament to continuously impinge on the filament traveling in said path;

means (4) continuously transducing an optical signal reflected by the filament (F) in said path into continuous electrical signals representative of the diameter of the filament, the beam generating means (3) and the transducing means (4) being located adjacent each other at the same side of the surface of the filament (F) with respect to the path of the filament through the beam of radiation, the transducing means (4) responding to light reflected from the surface of the filament in said path;

and means (10, 11; AS) continuously evaluating the instantaneous characteristics of the signals derived from said transducing means to thereby continuously monitor the thickness of said filament.

6. Apparatus according to claim 5, further comprising an optical system (5) between the beam generating means (3) and the filament in said path, and a receiver optical system (6) located between the filament (F) in said path and the tranducing means (4).

7. Apparatus according to claim 6, wherein the optical systems (5, 6) are oriented to have axes which cross at a point (8) in the path of the filament (F).

8. Apparatus according to claim 5, wherein the radiation beam generating means (3) comprises an infrared light source.

9. Apparatus according to claim 5, further comprising oscillator means (9) connected to the radiation beam generating means to control the radiation beam generating means to generate a modulated radiation beam.

10. Apparatus acccording to claim 9, further comprising a frequency selection stage (10) connected to the transducing means and selective to the frequency of the oscillator means (9);

and amplifier means (11) connected to said transducing means to provide an amplified output signal (AS).

11. Apparatus according to claim 10, wherein the frequency of oscillation of the oscillator is in the order of about 20 kHz; and the radiation beam generating means comprises a semiconductor electrical-optical transducer generating light rich in infrared radiation, the transducing means (4) being predominantly sensitive to light in the infrared range.

* * * * *